United States Patent [19]

Chung et al.

[11] Patent Number: 4,911,305

[45] Date of Patent: Mar. 27, 1990

[54] TEAR AWAY TOP STRUCTURE FOR A RECTANGULAR PAPERBOARD CONTAINER

[75] Inventors: Yun H. Chung; Dennis E. Chung, both of Toledo, Ohio

[73] Assignee: MPR Corporation, Perrysburg, Ohio

[21] Appl. No.: 189,662

[22] Filed: May 3, 1988

Related U.S. Application Data

[63] Continuation-in-part of Ser. No. 887,562, Jul. 17, 1986, abandoned.

[51] Int. Cl.[4] ..... B65D 5/40

[52] U.S. Cl. ..... 206/628; 206/621; 206/608; 206/624; 229/123.1

[58] Field of Search ..... 206/621, 622, 624, 628, 206/604, 605, 607, 608; 229/123.1, 123.3, 125.42

[56] References Cited

U.S. PATENT DOCUMENTS

| | | | |
|---|---|---|---|
| 2,758,775 | 8/1956 | Moore | 206/628 |
| 4,397,415 | 8/1983 | Lisiecki | 206/621 |
| 4,702,407 | 10/1987 | Lisiecki | 206/628 |

FOREIGN PATENT DOCUMENTS

| | | | |
|---|---|---|---|
| 130666 | 1/1985 | European Pat. Off. | 206/621 |

*Primary Examiner*—Willis Little

*Attorney, Agent, or Firm*—MacMillan, Sobanski & Todd

[57] ABSTRACT

A rectangular paperboard container includes an improved opening top structure which, when opened, provides a completely open top container. The container includes a tear line which extends substantially along the front and two side upper edges of the container. The tear line defines an openable top portion of the container which, when opened, is hingedly attached along the rear upper edge of the container. Preferably, the front tear line is located in a front panel of the container, and is spaced slightly downwardly from the front upper edge. The side tear lines can be located in either the respective side panels or in a top cover, and are also spaced from the respective upper side edges. In accordance with the present invention, an opening tab is operatively connected to the container along the upper front edge thereof. The opening tab is adapted to be folded against the front panel and substantially covers and protects the front tear line.

19 Claims, 5 Drawing Sheets

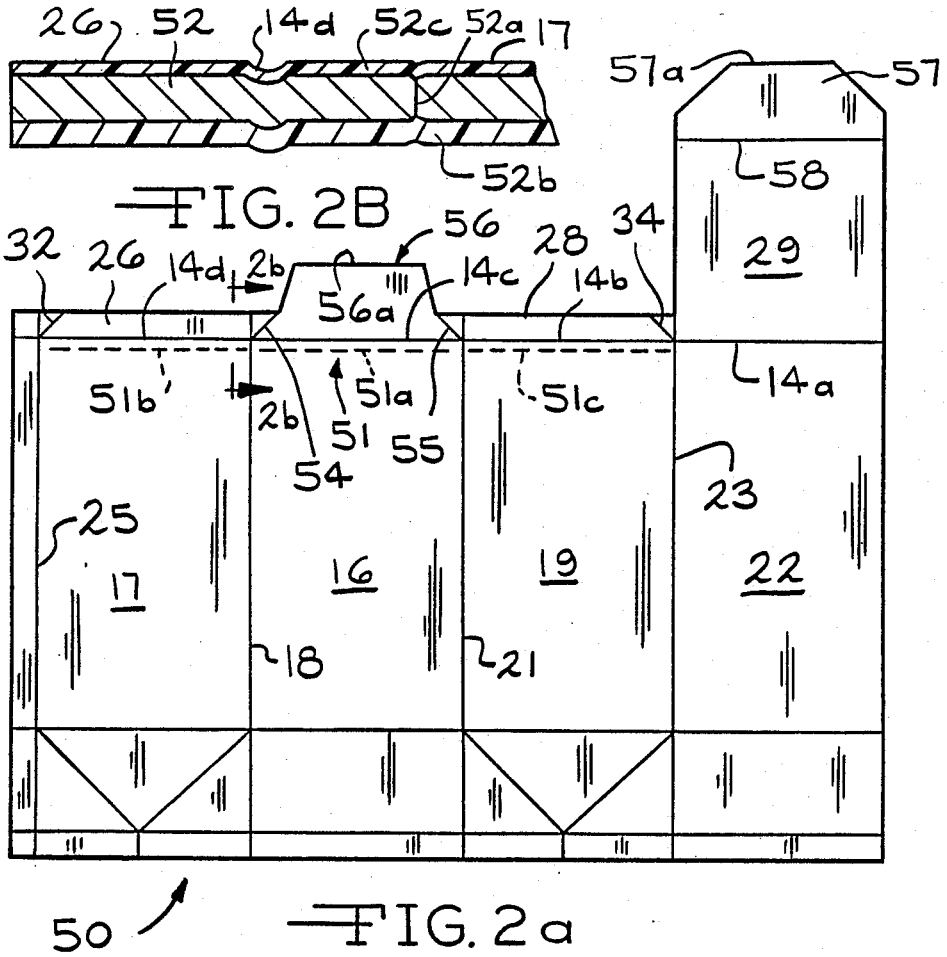
FIG. 2B
FIG. 2a
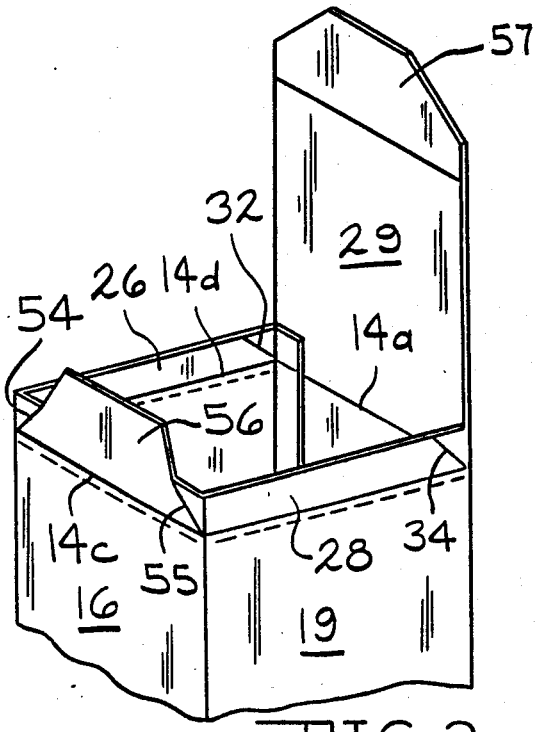
FIG. 2c
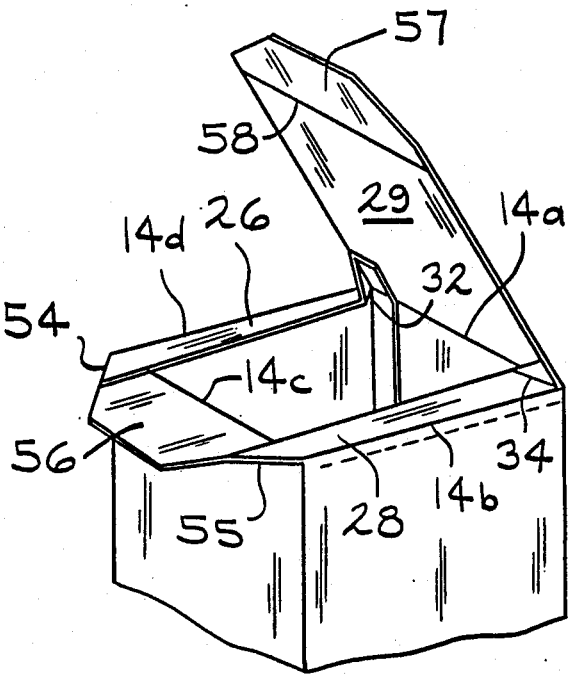
FIG. 2d

TEAR AWAY TOP STRUCTURE FOR A RECTANGULAR PAPERBOARD CONTAINER

CROSS-REFERENCE TO RELATED APPLICATION

This application is a continuation-in-part of application Ser. No. 06/887,562, filed July 17, 1986, assigned to the assignee of the present application, and which is herein incorporated by reference now abandoned.

BACKGROUND OF THE INVENTION

The present invention relates generally to a rectangular paperboard container which is formed of a sheet of laminated paperboard material and, in particular, to a paperboard container which is capable of holding a liquid product and is provided with a pull up, tear away top portion.

Laminated paperboard materials are becoming increasingly popular as a packaging material, especially in the food industry. A sheet of laminated paperboard material typically includes a central structural layer or core of paper to provide strength and rigidity to the associated package. In some instances, a layer of aluminum foil can be adhered to one surface of the paperboard to serve as a barrier layer against the passage of contaminates into the package. Generally, both surfaces of the paperboard/foil combination are then coated with a heat sealable thermoplastic material such as, for example, polyethylene. While a number of specific constructions are known, it is generally accepted practice to fold a precut and prescored sheet of paperboard material into a predetermined package configuration, and to seal the packages by applying heat and pressure to certain ocntacting surfaces of the paperboard. Also, it is known that ultrasonic welding units can be utilized to seal the packages.

SUMMARY OF THE INVENTION

The present invention is specifically concerned with an improved opening structure for a rectangular paperboard container. Generally, the container of the present invention includes a tear line which extends substantially along the front and two side upper edges of the container. The tear line defines an openable top portion of the container which, when opened, is hingedly attached along the back upper edge of the container. Preferably, the front tear line is located in a front panel of the container, and is spaced slightly downwardly from the front upper edge. The side tear lines can be located in either the respective side panels or in a top cover, and are also spaced from the respective upper side edges.

In accordance with the present invention, an opening tab is operatively connected to the container along the upper front edge thereof. The opening tab is adapted to be folded against the front panel and substantially covers and protects the front tear line.

In one embodiment of the invention, the front and side tear lines are all spaced downwardly from the adjacent upper edges. A top cover is integrally connected to the back panel at its upper edge. Also, each side panel includes an upper fold-in edge panel integrally connected to its upper edge, with the fold-in edge panels sealingly secured to bottom edge surfaces of the top cover. In this embodiment, the opening tab includes an inner portion integrally connected to the upper edge of the front panel and an outer portion integrally connected to the front marginal edge of the top over. The inner portion of the opening tab is folded outwardly from the front panel and has an upper surface sealingly secured to a lower surface of the outer portion.

In an alternate embodiment, the side tear lines are located in the top cover and are spaced inwardly from the adjacent side marginal edges, while the front tear line is located in the front panel and is spaced downwardly from its upper edge. The top cover is formed by extentions integrally connected to upper edges of the side panels. The extentions are folded inwardly and are secured to one another to define a top seam line extending through the top cover. In this embodiment, the opening tab is formed by an upper front extension integrally connected to an upper edge of the front panel. The front extension is folded in a generally triangular configuration and is sealingly secured along the top seam line.

It has been found that a paperboard container having the above-described construction provides an easy-open top structure which, when opened, provides a completely open top for the discharge of the contents of the container. This is especially desirable if the contents of the container are in substantially block form, such as fruit juice concentrate in either a frozen or semi-frozen state.

Other features and advantages of the present invention will become readily apparent to one skilled in the art from reading the following detailed description of the invention in conjunction with the attached drawings.

BRIEF DESCRIPTION OF THE DRAWINGS

FIG. 2*a* is a plan view of a blank which has been precut and prescored and is suitable for fabricating a container having an opening structure according to the present invention;

FIG. 2*b* is a fragmentary sectional view taken along the line 2*b*–2*b* of FIG. 2*a* and illustrating the which perforations are cut in the paperboard prior to laminating or extruding any plastic layers thereon;

FIG. 2*c* is a perspective view of the upper portion of the container after the blank of FIG. 2*a* has been formed into an open squared tubular condition;

FIG. 2*d* is similar to FIG. 2*c*, but illustrates the container after the upper side edge panels have been folded inwardly and the upper front edge panel has been folded outwardly;

DESCRIPTION OF THE PREFERRED EMBODIMENTS

Figure 1B:
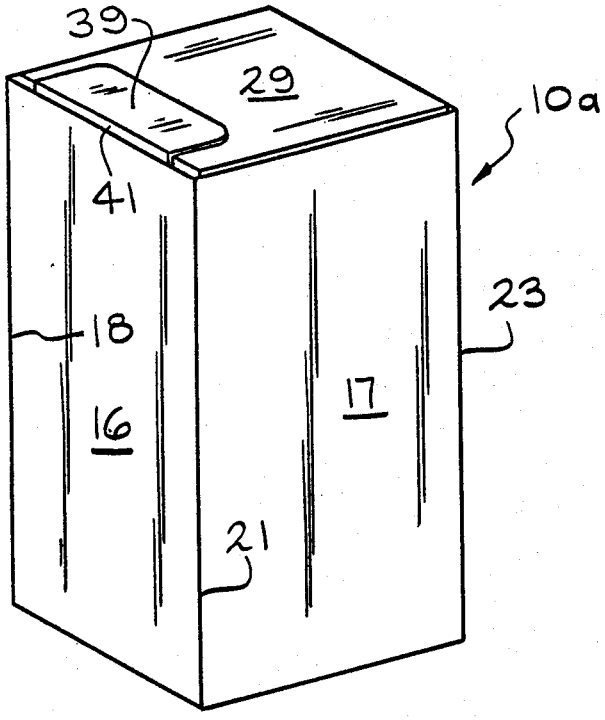
FIG. 1b (PRIOR ART)
FIG. 1*b* illustrates a prior art rectangular paperboard container which can be fabricated from the blank shown in FIG. 1*a;*
Figure 1C:
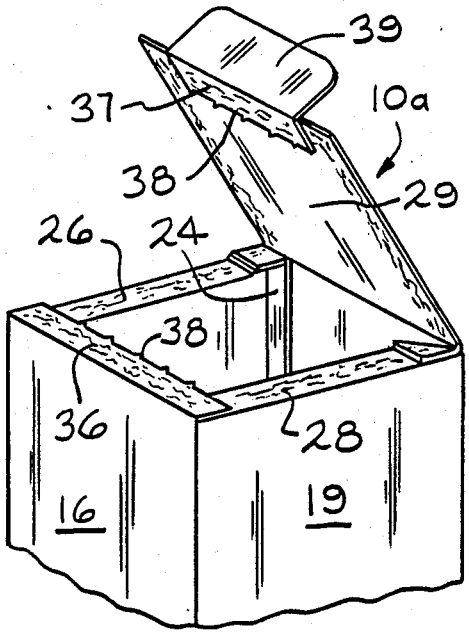
FIG. 1c (PRIOR ART)
FIG. 1*c* illustrates the upper portion of the prior art container of FIG. 1*b*, after the lifting tab has been pulled upwardly with the top panel to open the container.
Figure 1A:
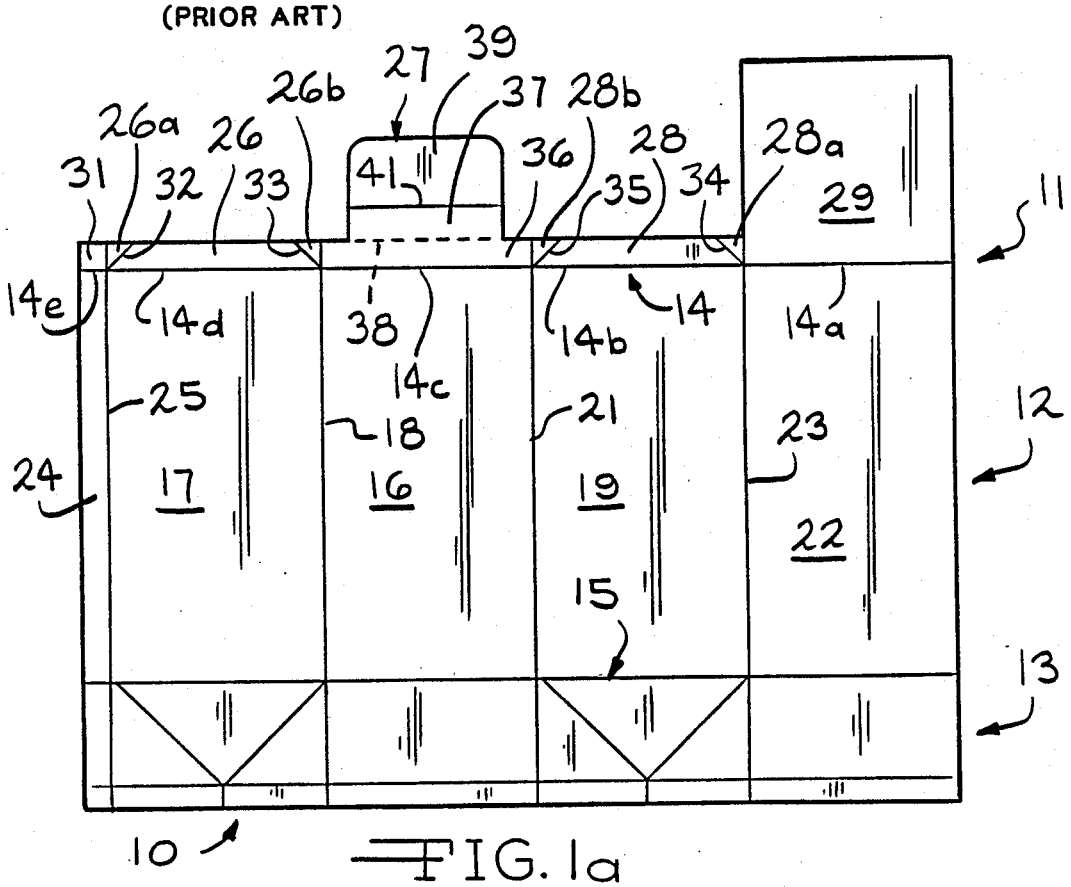
FIG. 1a (PRIOR ART)
FIG. 1*a* illustrates a blank construction of a prior art rectangular paperboard container.

The container of the present invention is specifically concerned with an improvement to the container structure disclosed in U.S. Pat. No. 4,397,415, which is herein incorporated by reference. While a detailed description of the prior art container can be found in the above-identified patent, for purposes of fully understanding the present invention, the prior art container is generally illustrated in FIGS. 1*a* through 1*c* of the present application. Referring to FIG. 1*a*, there is shown a container blank 10 which is utilized to form the prior art container 10*a* of FIGS. 1*b* and 1*c*. The container blank 10 is generally divided into three sections and includes a top end portion 11, a main body portion 12, and a bottom end portion 13.

More specifically, the top end portion 11 is connected to the main body portion 12 by a top horizontal fold or score line 14, which includes colinear sections 14*a*, 14*b*, 14*c*, 14*d* and 14*e*. The body portion 12 is separated from the bottom end portion 13 by a bottom horizontal score line 15. It should be noted that, in some instances, such as when the paperboard material is relatively thick, it may be preferable to stagger portions of the top and bottom horizontal score lines in a manner as described in U.S. Pat. No. 4,397,415.

The bottom end portion 13 includes a plurality of score lines which are situated to enable the carton bottom to be sealed in a conventional manner such as, for example, the manner shown in FIG. 10 of U.S. Pat. No. 4,327,833, which is herein incorporated by reference.

The main body portion 12 comprises a plurality of integrally connected body panels which includes a front panel 16 connected to a first side panel 17 along a vertical score line 18, and connected to a second side panel 19 along a vertical score line 21. A back panel 22 is connected to the second side panel along a vertical score line 23, while a side seam flap 24 is connected to the first side panel 17 along a vertical score line 25.

The top end portion 11 includes a first side fold-in edge panel 26 connected to the upper edge of the first side panel 17 along the score line 14*d*, a front fold-in edge panel 27 connected to the upper edge of the front panel 16 along the score line 14*c*, a second side fold-in edge panel 28 connected to the upper edge of the second side panel 19 by the score line 14*b*, and a cover panel 29 connected to the upper edge of the back panel 22 by the score line 14*a*. A further panel 31 is integrally connected to the upper edge of the side seam flap 24 along the score line 14*e*.

The first side fold-in edge panel 26 is provided with diagonal score lines 32 and 33 at the ends thereof which form triangular fold over panel segments 26*a* and 26*b*, respectively. Similarly, the second side fold-in edge panel 28 is provided with diagonal score lines 34 and 35 at the ends thereof which form triangular fold-over panel segments 28*a* and 28*b*, respectively. The front edge panel 27 includes a fold-in section 36 connected to the front panel 16 along the score line 14*c*, an intermediate section 37 extending from the panel section 36 and connected thereto along a weakened or perforated score line 38, and an upper tab section 39 connected to the intermediate segment 37 along a score line 41. The distance between the score line 41 and the weakened line 38 is approximately equal to the distance between the score line 14*c* and the weakened line 38.

The container blank 10 illustrated in FIG. 1*a* is first formed into a flattened side seam blank in the customary manner as described in detail in U.S. Pat. No. 4,397,415. As described in this patent, it has been found preferable to first form and seal the top section and then, after filling the container through the open bottom end, the bottom panel section is closed and sealed in a conventional manner to completely close the container.

Accordingly, after the flattened side seam blank is formed, it is opened up into a square tubular condition and the various parts of the eventual top end portion 11 are folded on the various score lines in the following manner so as to form the top end structure as shown in FIG. 1*b*. More specifically, the first and second side fold-in edge panels 26 and 28 are folded or bent inwardly along the score line sections 14*d* and 14*b*, respectively, which folding causes bending of the first side edge panel 26 along the diagonal score lines 32 and 33 and folding of the second side edge panel 28 along the diagonal score lines 34 and 35. Next, the entire front edge panel 27 is folded inwardly along the score line 14*c*, and then folded outwardly along the perforated score line 38, causing the "outside" surfaces of the panels sections 36 and 37 to come in contact with one another. Finally, the cover panel 29 is folded inwardly along the score line 14*a*, causing the triangular panel sections 26*a* and 28*a* to be pressed downwardly into engagement with the respective side edge panels 26 and 28.

The sealing of the interrelated elements of the top end portion 11 is then accomplished by conventional means, such as sonic or high frequency vibration sealing means or by other means, such as gas heat, if desired. After the top cover panel 28 has been sealed to the folded front and side edge panels, the lift tab 39 can be folded upwardly about the score line 41 and spot welded to the upper surface of the top cover 29, as shown in FIG. 1*b*. Alternatively, the lifting tab 39 can be folded downwardly about the score line 41 and spot welded to the outside surface of the front panel 16.

In opening the carton, the lift tab 39 is lifted from the top panel 29 and is pulled upwardly, causing the panel section 37 to pull away from the panel section 36 and breaking the weakened score line 38. As the lifting tab 39 is raised further, the cover panel 29 is pulled away from the side edge panels 26 and 28 which, except for the front edge section 36 and the side edge panels 26 and 28, provides an open top for the discharge of the contents of the container.

The present invention concerns various modifications to the top end closure 11 of the prior art container of FIGS. 1*a* through 1*c* which enable the container to open in such a manner as to provide a completely open top.

Referring now to FIGS. 2*a* through 2*g*, there is illustrated an alternate blank and container embodiment, wherein all of the elements which are the same as those in the FIG. 1*a* through 1*c* embodiment bear the same reference numerals. The embodiment shown in these figures is comparable to the embodiment of FIGS. 1*a* through 1*c*, except that certain important modifications have been made to the top closure elements 11 such that, when the container is opened, a completely opened top is provided. In particular, a blank 50 is provided with a perforated or tear line 51 consisting of a first section 51*a* formed in the front panel 16 and spaced slightly downwardly from the score line 14*c*, a second section 51*b* formed in the first side panel 17 and spaced slightly downwardly from the score line 14*d*, and a third section 51*c* formed in the second side panel 19 and spaced slightly downwardly from the score line 14*b*.

The perforated tear line 51 is preferably formed during the manufacturing of the paperboard material composite. In particular, as shown in the sectional view of FIG. 2*b*, it is desirable to first form the cuts which define the tear line 51 in the paperboard core prior to the lamination or extrusion of any plastic or foil coatings thereto. As shown in FIG. 2*b*, a paperboard core 52 is provided with a perforation opening or cut 52*a*, which forms are of the dashed cuts of the tear line section 51*b*. The cut 52*a* preferably extends substantially through the entire thickness of the core 52. After the perforation pattern has been cut in the paperboard material by a suitable die means, the inner and outer plastic layers 52*c* and 52*b* can be applied to the paperboard surfaces in a conventional manner, as by either an extrusion or a laminating process. It will be appreciated that the thicknesses of the inner and outer plastic layers 52*b* and 52*c* can vary depending on the particular packaging requirements. Thus, the tear line 51 defines a predetermined path along which the container can be opened, but which maintains the sealing and barrier properties of the container prior to opening.

It is preferable that none of the perforation cuts be directly along any of the score lines, or that they intersect any of the scored lines. Thus, as shown in FIG. 2*a*, the perforated tear lines 51*a*, 51*b*, and 51*c* are spaced slightly downwardly from the fold lines 14*c*, 14*d*, and 14*b*, respectively. Also, it should be noted that the ends of the perforation line 51*a* are spaced from the vertical fold lines 18 and 21. Similarly, the ends of the score line 51*b* are spaced from the fold lines 18 and 25, while the ends of the perforation line 51*c* are spaced from the fold lines 21 and 23.

In addition to the inclusion of the perforation line 51, other modifications have also been made in the embodiment of FIG. 2*a*. In particular, the first and second upper side edges 26 and 28 do not include the diagonal fold lines 33 and 35 as shown in FIG. 1*c*. Instead, diagonal fold lines 54 and 55 are formed at the ends of a modified front edge section 56. The front edge section 56 functions as an inner lifting tab and is integrally connected to the front panel 16 along the score line 14*c*. It should be noted that the front panel section 56 does not include a weakened perforation line such as the line 38 as shown in FIG. 1*a*.

The final modification included in FIG. 2*a* is the addition of an outer lifting tab section 57 which extends upwardly from the top cover panel 29 and is connected thereto along a fold line 58. Preferably, the distance between the fold line 58 and an outer parallel edge 57*a* of the outer lifting tab section 57 is approximately equal to the distance between the fold line 14*c* and an outer edge 56*a* of the inner lifting tab section 56.

The container blank 50 illustrated in FIG. 2*a* is first formed into a flat side seam blank in the customary manner and is then opened up into a squared tubular condition as shown in FIG. 2*c*. Next, the first and second side edge panels 26 and 28 are folded inwardly along the score lines 14*d* and 14*b* while, simultaneously, the front upper edge section 56 is folded outwardly along the score line 14*c* to cause folding along the diagonal score lines 54 and 55, while beginning folding along the diagonal score lines 32 and 34. Next, the top panel 29 is folded and bent inwardly and downwardly along the fold line 14*a* such that the side marginal edges of the panel 29 are pressed into engagement with the first and second side edge panels 26 and 28, while the upper surface of the inner opening tab 56 is pressed into engagement with the bottom surface of the outer opening tab 57. Sealing of the interrelated elements of the top closure is then accomplished by conventional means.

Figure 2E:
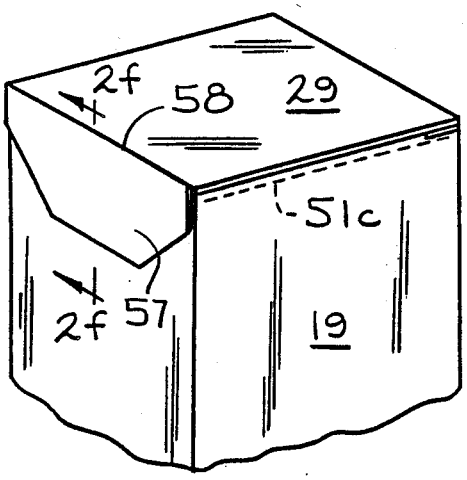
FIG. 2*e* is similar to FIG. 2*d*, but shows the container after the top panel has been sealed against the upper side and front edge panels and the opening tab has been folded downwardly against the front panel.

Next, the inner opening tab 56 and the outer opening tab 57 are folded downwardly about score lines 14*c* and 58, respectively, such that the inner opening tab 56 is adjacent the outside surface of the front panel 16, at which point the opening tabs can be spot welded thereto to produce a container having a top construction as shown in FIG. 2*e*.

Figure 2F:
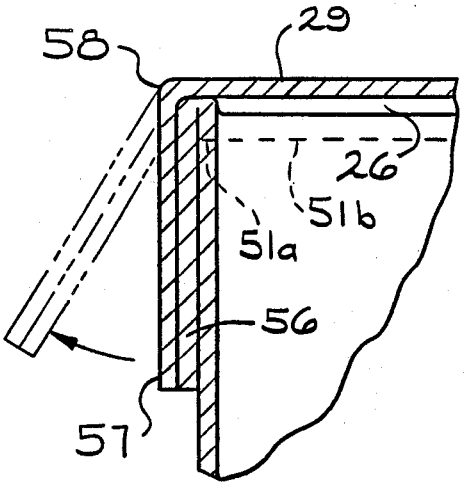
FIG. 2*f* is a sectional view taken along the line 2*f*–2*f* of FIG. 2*e*.
Figure 2G:
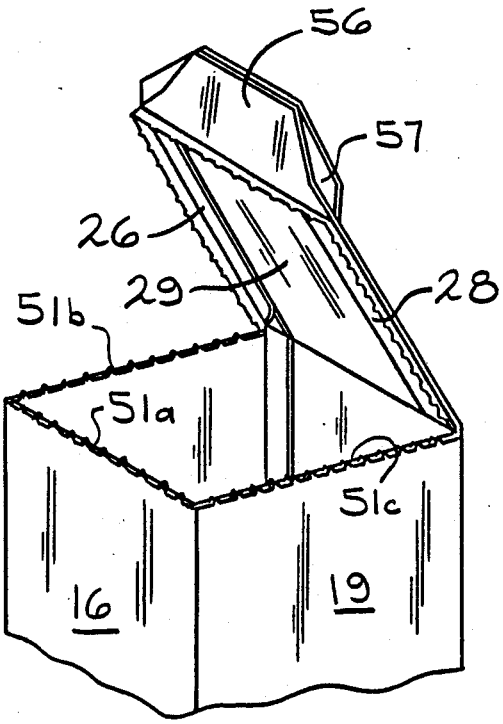
FIG. 2*g* is a perspective view, similar to FIG. 2*e*, but showing the container after the lifting tab has been pulled upwardly to break the container along the preformed tear lines.

As shown in the sectional view of FIG. 2*f* (which, for simplicity, does not show inner and outer plastic layers on the paperboard core), when the opening tab sections are folded against the front panel 16, the perforation line 51*a* is completely covered and protected by the opening tab sections 56 and 57. When it is desirable to open the container, the opening tab sections are pulled away from the front panel, as shown in phantom in FIG. 2*f*, and are then pulled upwardly to cause the top of the container to separate along the tear lines 51*a*, 51*b* and 51*c*, to provide a completely open container as shown in FIG. 2*g*.

Figure 3A:
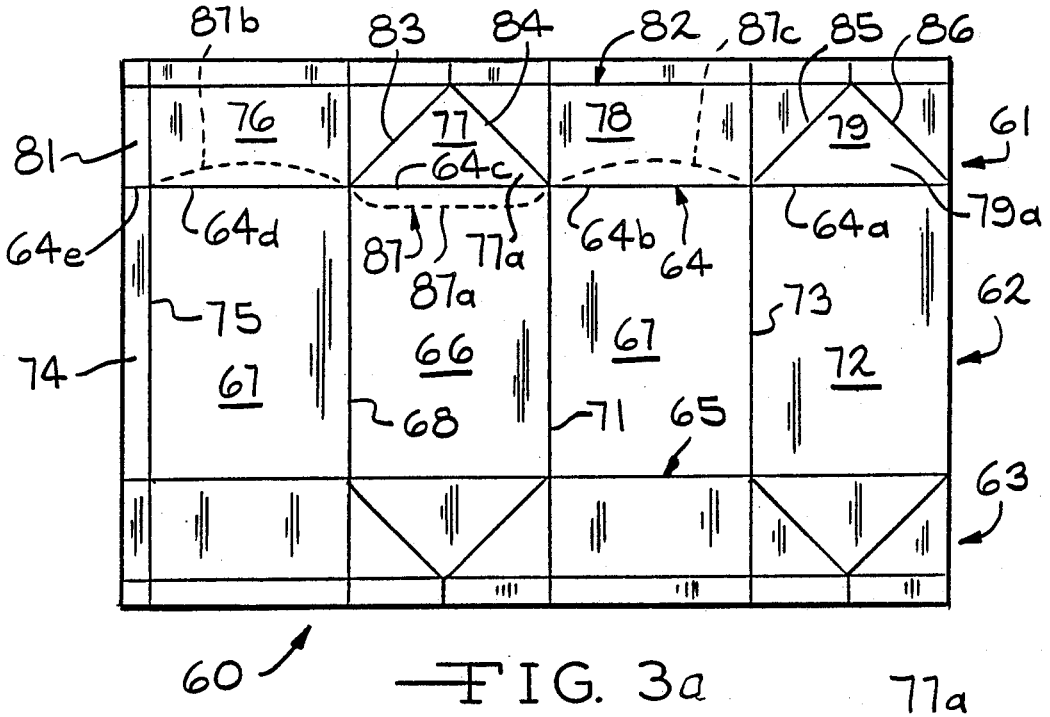
FIG. 3*a* is a plan view of an alternate embodiment of a blank structure according to the present invention.
Figure 3B:
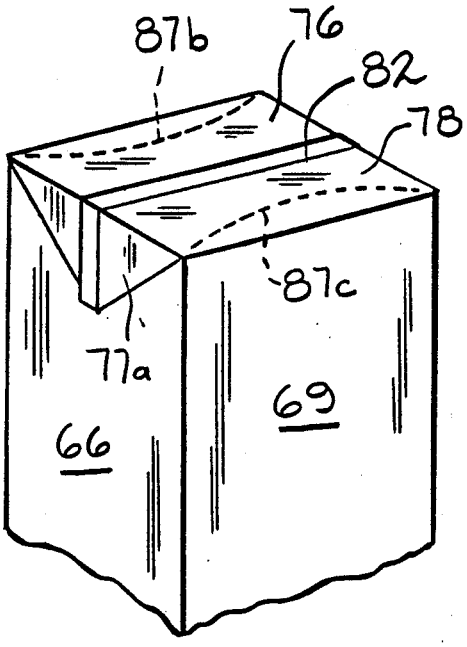
FIG. 3*b* is a perspective view of the top portion of the container which has been fabricated from the blank shown in FIG. 3*a;*
Figure 3C:
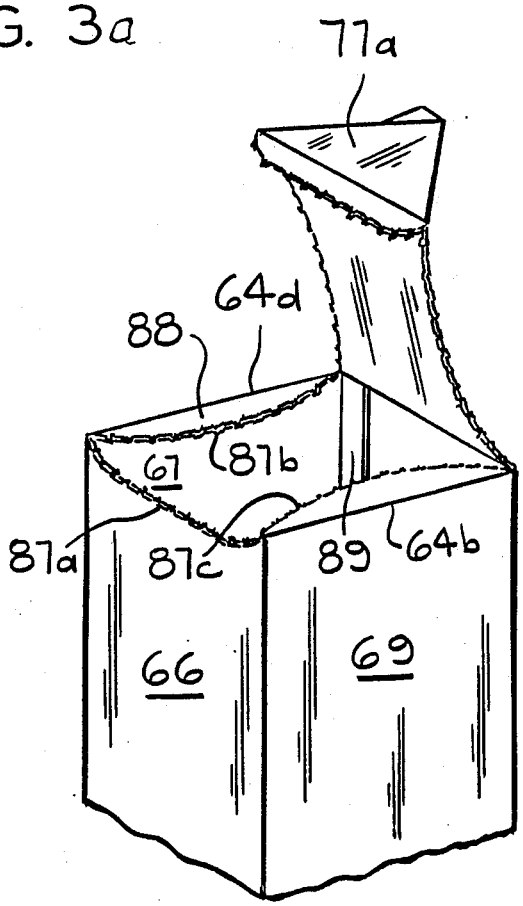
FIG. 3*c* is a perspective view of the top portion of the container of FIG. 3*b* after the lifting tab has been pulled upwardly to open the container along the preformed tear lines.

Referring now to FIGS. 3*a* through 3*c*, there is shown an alternate embodiment of an opening structure according to the present invention. In FIG. 3*a*, there is shown an alternate embodiment of a blank 60 which is generally divided into three sections and includes a top end portion 61, a main body portion 62, and a bottom end portion 63. The top portion 61 is connected to the main body portion 62 by a top horizontal score line 64 which includes colinear sections 64*a*, 64*b*, 64*c*, 64*d*, and 64*e*. The main body portion 62 is separated from the bottom enclosure portion 63 by a bottom horizontal score line 65. As previously mentioned, either or both of the horizontal score lines 64 and 65 can have portions staggered from one another to accommodate folding of relatively thick paperboard.

The bottom enclosure portion 63 is similar in construction and is sealed in a manner similar to the bottom end closure portion 13 of FIG. 1*c*.

The main body portion 62 comprises a plurality of integrally connected body panels which include a front panel 66 connected to a first side panel 67 along a vertical score line 68 and connected to a second side panel 69 along a vertical score line 71. A back panel 72 is connected to the second side panel 69 along a vertical score line 73. A side seam flap 74 is connected to the first side panel 67 along a vertical score line 75.

The top end portion 61 has a construction and score line arrangement substantially identical to that of the bottom section 63. The top end portion 61 includes a first side panel extension 76 connected to the first side panel 67 along the score line **64*d*, a front panel extension 77 connected to the front panel 66 along the score line 64*c*, a second side panel extension 78 connected to the second side panel 69 along the score line 64*b*, a back panel extension 79 connected to back panel 72 along the score line 64*a*, and a side seam flap extension 81 connected to the side seam flap 75 along the score line 64*c*. A horizontal score line 82 is spaced downwardly from the upper edge of the blank 60 and extends through the extensions 76, 77, 78, 79 and 81. A pair of diagonal score lines 83 and 84 are provided in the front panel extension 77 and define a triangular portion 77*a*. A pair of diagonal score lines 85 and 86 are provided in the back panel extension 79 and define a triangular portion 79*a***.

In addition to the various score lines, the top end portion 61 is provided with a perforated tear line means 87 which, as will be discussed, assists in opening the container. In particular, the tear line means 87 includes a first section **87*a* located in the front panel 66 and spaced downwardly from the fold line 64*c*, a second section 87*b* located in the first side panel extension 76 and spaced from the fold line 64*d*, and a third section 87*c* located in the second side panel extension 78 and spaced from the fold line 64*b*. The perforated tear line sections 87*a*, 87*b*, and 87*c* are formed in a manner similar to the perforated lines of FIG. 2*a***, i.e., the perforations are die cut in the paperboard core prior to laminating or extruding any foil or plastic layers thereon.

The blank of FIG. **3*a* is formed into a rectangular paperboard carton in a manner similar to the blank shown in FIG. 1*a*, except that the top section 61 is sealed in a manner similar to that of the bottom section 63. Once the top transverse seal has been made above the fold line 82, the triangular end portions 77*a* and 79*a* formed by the front and back panel extensions 77 and 79, can be folded downwardly against the front and rear panels 66 and 72, respectively, as shown in FIG. 3*b*. Normally, as in the case of the bottom section 63**, the triangular ear portions would be folded against the bottom of the container such that they are not visible along the sides of the container.

Once folded in the manner as shown in FIG. **3*b*, the triangular section formed by the front panel extension 77 functions as an opening tab to assist in opening the container along the line defined by the perforated score line 87. In particular, a user can grasp the triangular section and, by pulling upwardly, break the carton along the tear lines 87*a*, 87*b* and 87*c* to open the carton, as illustrated in FIG. 3*c*. Once opened, it will be noted that the tear line 87*b* cooperates with the fold line 64*d* to define an ear portion 88 hingedly attached to the first side panel 67 along the fold line 64*d*. Since the tear line 87*b* originates adjacent one corner at the top and terminates adjacent an opposite corner, the ear portion 88 can easily be hinged upwardly along the fold lines 64*d*. Similarly, the tear line 87*c* cooperates with fold line 64*b* to define a second ear portion 89 which can be hinged upwardly along the fold line 64*b*. When both ear portions 88 and 89** are hinged upwardly, a completely open top container is provided.

Figure 4A:
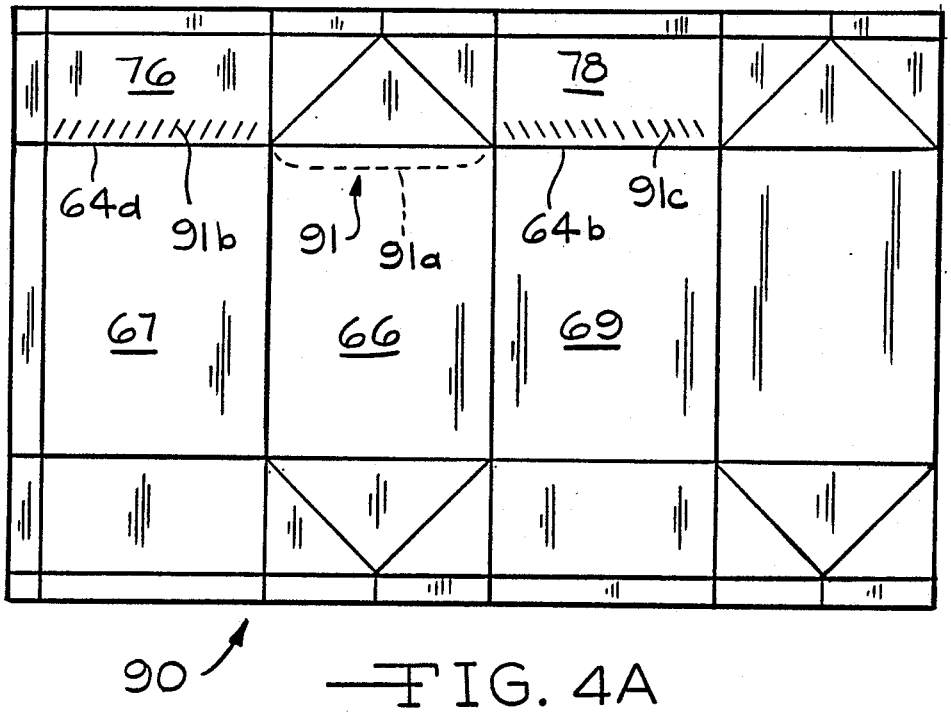
FIG. 4*a* is a plan view of a further alternate embodiment of a blank structure according to the present invention.

Referring now to FIGS. **4*a* through 4*c*, there is shown a further alternate embodiment of a opening structure according to the present invention. In FIG. 4*a*, a blank 90 is illustrated which, except for the design and location of the perforation lines, is essentially identical to the blank 60 of FIG. 3*a*. Accordingly, elements in FIG. 4*a* which are the same as those in FIG. 3*a*** will bear the same reference numerals.

Figure 4B:
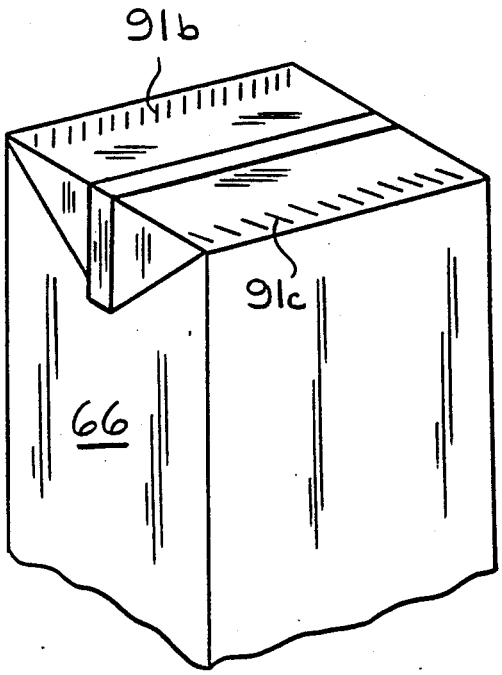
FIG. 4*b* is a perspective view of the top portion of a container which has been fabricated from the blank of FIG. 4*a*.
Figure 4C:
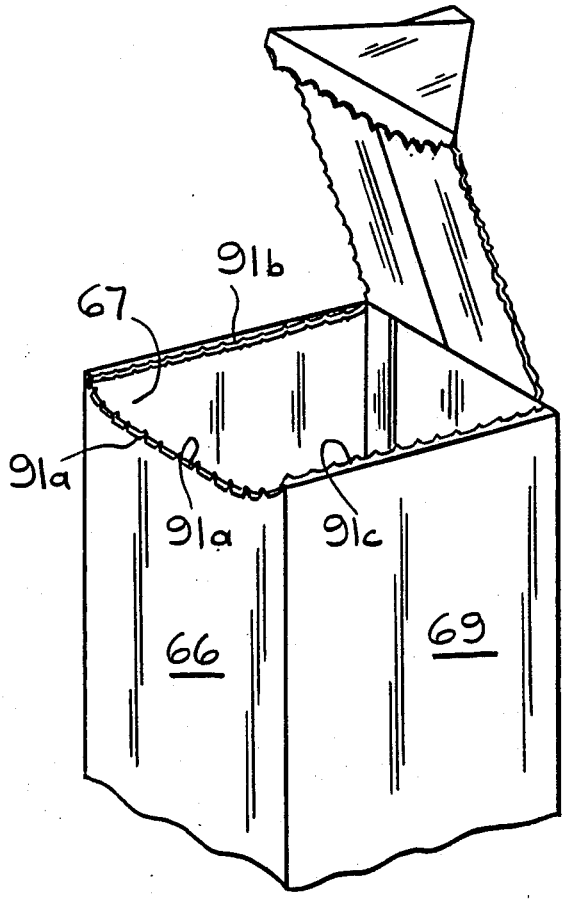
FIG. 4*c* is a perspective view of the top portion of the container illustrated in FIG. 4*b* after the lifting tab has been pulled upwardly to open the container along the performed tear lines.

In FIG. **4*a*, a tear line means 91 consists of a first section 91*a* located in the front panel 66 and formed in a manner similar to the tear line 87*a* of FIG. 3*a*. The tear line means 91 also includes a second section 91*b* located in the first upper side panel extension 76, and a third section 91*c*, located in the second side panel extension 78. The tear line pattern 91*b* consists of a plurality of angled perforation cuts which are parallel to one another, and extend alongside the fold line 64*d*. Similarly, the perforation pattern 91*c* includes angled cuts which are parallel to one another and extend alongside the fold line 64*b*. When folded, the blank 90 of FIG. 4*a* will have an upper section as shown in FIG. 4*b*. The container of FIG. 4*b* is opened in a manner similar to that of the container in FIG. 3*b*. However, once the tear lines 91*a*, 91*b* and 91*c* have been ripped, the portion of the top panel which remains attached along the fold line 64*a* and 64*c*** is minimal, such that the container provides a substantially completely open top.

It will be appreciated that the embodiments of the blank shown in FIGS. **2*a*, 3*a*, and 4*a*, all produce a carton having an opening top structure which provides a completely open top to assist in the removal of the contents of the container. In each of the designs, a front lifting tab is folded downwardly against the front face of the front panel and functions to protect the tear lines formed adjacent the top edge thereof. Moreover, the tear lines which extend along the upper edges of the side panels, whether located in the side panels (FIG. 2*a* embodiment) or in the top panel (FIGS. 3*a* and 4*a*** embodiment) are designed in such a manner as to provide a substantially completely open top once the tear lines have been ripped.

The present invention has been illustrated and described in its preferred embodiments. However, it will be appreciated that other modifications can be made to these embodiments without departing from the spirit or scope of the attached claims. For example, in some instances, it may be desirable to form the package with a perforation pattern different than the one specifically illustrated and described. Also, in the case of the embodiments of FIG. **3*a* and FIG. 4*a***, it may be desirable in some instances to fold the triangular tab sections upwardly against the top of the container to provide protection for the perforation lines located on the top panel.

What is claimed is:

1. A paperboard container comprising:

parallel and spaced apart front and back panels connecting parallel and spaced apart first and second side panels;

said first side panel connected to said back panel by means of a side seam seal flap which is integrally connected to one of said first side and back panels and is sealingly secured to the other one of said first side and back panels;

a top cover connected to upper marginal edges of said front, back, and first and second side panels;

tear line means including a first section located in said front panel along an upper marginal edge thereof, a second section extending generally alongside an upper marginal edge of said first side panel, and a third section extending generally alongside an upper marginal edge of said second side panel;

said first, second, and third sections of said tear line means cooperating to define a portion of said container to be opened such that, when said first, second, and third sections of said tear line means are severed, said openable portion remains hingedly attached along a back marginal edge of said top cover;

said front panel including an upper extension hingedly attached along an upper marginal edge thereof and said top cover including a front extension hingedly attached along a front marginal edge thereof, said entire upper extension and said front extension extending outwardly from the interior of said container and having inner surfaces in facing relationship with one another, said upper extension and said front extension connected together to define an opening tab; and said opening tab operatively connected to said openable portion of said container, said opening tab adapted to be grasped by a user of said container to cause said container to sever along said first, second, and third sections and thereby open said container.

2. The container according to claim 1 wherein said paperboard material includes a paper core having a thermoplastic layer on at least one surface thereof.

3. The container according to claim 2 wherein said tear line means includes cuts extending only through said paper core.

4. The container according to claim 3 wherein said opening tab is folded downwardly against an outer surface of said front panel.

5. The container according to claim 4 wherein said second section of said tear line means is located in said first side panel and said third section of said tear line means is located in said second side panel.

6. The container according to claim 5 wherein said first, second, and third sections of said tear line means are all spaced downwardly from the upper marginal edges of said front, first side, and second side panels respectively.

7. The container according to claim 6 wherein:

said top cover is integrally connected to said back panel along an upper marginal edge thereof;

each of said first and second side panels includes an upper fold-in edge panel integrally connected to upper edges thereof, said fold-in edge panels sealingly secured to bottom edge surfaces of top cover;

said opening tab including an inner portion integrally connected to an upper edge of said front panel and an outer portion integrally connected to a front marginal edge of said top cover;

said inner portion being folded outwardly from said front panel and having an upper surface sealingly secured to a lower surface of said outer portion.

8. The container according to claim 4 wherein said second and third sections of said tear line means are located in said top cover.

9. The container according to claim 8 wherein said top cover is formed by a first extension integrally connected to an upper marginal edge of said first side panel and a second extension integrally connected to an upper marginal edge of said second side panel, said first and second extensions being folded inwardly and sealingly secured to one another to define a top seam line extending through said top cover, said opening tab being formed by an upper front extension integrally connected to an upper marginal edge of said front panel, said front extension being folded in a generally triangular configuration and sealingly secured along said top seam line.

10. A blank of paperboard material for constructing a container comprising:

(a) generally rectangular body panels including front and back panels, first and second side panels, and a side seam flap integrally connected together by spaced apart and parallel side score lines;

(b) a top cover integrally connected to at least one of said back and first and second side panels;

(c) a tear line means including a first section located in said front panel along an upper marginal edge thereof, a second section extending generally alongside an upper marginal edge of said first side panel, and a third section extending generally alongside an upper marginal edge of said second side panel; and (d) an opening tab including an inner portion hingedly connected to an upper marginal edge of said front panel and an outer portion hingedly connected to a marginal edge of said top cover.

11. The blank according to claim 10 wherein said paperboard material includes a paper core having a thermoplastic layer on at least one surface thereof.

12. The blank according to claim 11 wherein said tear line means includes cuts extending only through said paper core.

13. The blank according to claim 12 wherein said second section of said tear line means is located in said first side panel and said third section of said tear line means is located in said second side panel.

14. The blank according to claim 13 wherein said first, second, and third sections of said tear line means are all spaced downwardly from the upper marginal edges of said front, first side, and second side panels respectively.

15. The blank according to claim 14 wherein:

said top cover is integrally connected to said back panel along an upper marginal edge thereof;

each of said first and second side panels includes an upper fold-in edge panel integrally connected to upper edges thereof; and said opening tab includes an inner portion integrally connected to an upper edge of said front panel and an outer portion integrally connected to a front marginal edge of said top cover.

16. The blank according to claim 12 wherein said second and third sections of said tear line means are located in said top cover.

17. The blank according to claim 16 wherein said top cover includes a first extension integrally connected to an upper marginal edge of said first side panel and a second extension integrally connected to an upper marginal edge of said second side panel, and said opening tab includes an upper front extension integrally connected to an upper marginal edge of said front panel.

18. The container according to claim 1 wherein said front panel is constructed of a single, seamless, paperboard sheet.

19. The blank according to claim 10 wherein said front panel is constructed of a single, seamless, paperboard sheet.

* * * * *